US005482245A

United States Patent [19]

Graves

[11] Patent Number: 5,482,245

[45] Date of Patent: Jan. 9, 1996

[54] TREE AND POLE STAND

[76] Inventor: Lori L. Graves, 3851 Kenroy Rd., Duluth, Minn. 55811

[21] Appl. No.: 410,405

[22] Filed: Mar. 27, 1995

Related U.S. Application Data

[63] Continuation of Ser. No. 143,880, Oct. 28, 1973, abandoned.

[51] Int. Cl.[6] ..... A47G 33/12

[52] U.S. Cl. ..... 248/523; 248/188.7; 248/529; 248/132; 248/166

[58] Field of Search ..... 248/523, 524, 248/529, 124, 125, 231, 603, 127, 132, 538, 539, 188.7, 163.1, 165, 166, 432, 434, 171, 519, 213.2, 311.2

[56] References Cited

U.S. PATENT DOCUMENTS

| | | | |
|---|---|---|---|
| 2,891,747 | 6/1959 | Steede | 248/524 |
| 2,980,377 | 4/1961 | Nielsen et al. | 248/523 |
| 3,469,342 | 9/1969 | Morris | 248/523 X |
| 3,591,114 | 7/1971 | Beatty | 248/529 |
| 3,862,733 | 1/1975 | Sullivan | 248/529 |
| 3,966,153 | 6/1976 | Fleck | 47/40.5 |
| 3,987,996 | 10/1976 | Yocca | 248/524 |
| 4,032,098 | 6/1977 | Marschak | 248/529 X |
| 4,320,886 | 3/1982 | Stodola | 248/523 |
| 4,406,437 | 9/1983 | Wright | 248/529 |
| 4,778,140 | 10/1988 | Korlewski | 47/40.5 |
| 4,825,586 | 5/1989 | Coppedge | 248/529 |
| 4,911,391 | 3/1990 | Ellis | 248/188.7 |
| 5,000,414 | 3/1991 | Rosato | 47/40.5 |
| 5,169,111 | 12/1992 | Dunaj | 248/523 |
| 5,236,167 | 8/1993 | Tai et al. | 248/529 |
| 5,249,772 | 10/1993 | Montie, Jr. et al. | 248/523 |

*Primary Examiner*—Leslie A. Braun
*Assistant Examiner*—Catherine S. Collins
*Attorney, Agent, or Firm*—Vidas, Arrett & Steinkraus

[57] ABSTRACT

A tree or pole stand is disclosed. The stand or support includes an outer container, an inner container receivable by the outer container and a plurality of braces connected to the outer container. The support may be placed in a decorative container such that the braces abut the inner wall of the decorative container.

27 Claims, 4 Drawing Sheets

TREE AND POLE STAND

This is a continuation of application Ser. No. 08/143,880 filed on Oct. 28, 1993 now abandoned.

FIELD OF THE INVENTION

This invention is related to a stand and more particularly, to a tree stand for holding real or artificial trees, poles and the like.

BACKGROUND OF THE INVENTION

Christmas tree buyers are reminded every season of the problems of finding a stable, attractive holder for their tree. Typical tree stands include three legs. This often leaves the user catching the tree, as the stand is unstable. The stand often rests on just two legs and ultimately falls. Users end up tying the tree to a window latch or some other inconvenient, unattractive location to gain stability.

Further, the typical tree stand secures the tree by a metal ring and a few screws to the bottom 3–5 inches of the trunk. Thus, the tree often wobbles and will never stand straight. This traditional type of tree stand is for Christmas trees only. Further, the tree stand is not attractive in appearance and most users make efforts to cover the stand with an ornamental tree skirt. The skirt is a problem in itself. The skirt does not allow easy access to the tree for watering and usually needs straightening more than one would like.

It is also a problem to find a suitable stand for an artificial tree. A user wants to utilize a stand that is decorative for trees other than at Christmas. Using a tree skirt to hide the stand is not an option beyond the Christmas season. It is also difficult to find a stable stand. Most common is a planter filled with concrete. However, this solution does not allow for easy movement of the assembly. The containers filled with concrete are quite heavy.

It is also a problem to find a suitable holder for a pole, such as a flag pole, or garden candle. It is difficult to stick the pole in the ground and it is more decorative and stable to use a holder of some sort. Thus, there is a need for a stand that is durable, versatile and provides necessary support to a tree or pole.

SUMMARY OF THE INVENTION

This invention provides an improved stand or support for trees and the like. The support includes an outer container. The outer container includes a bracing mechanism. The bracing mechanism is made up of a plurality of straight and angled channel arms which are adjustable and are connected to stationary and transferable straps. The transferable strap is movable. The bracing mechanism forms a plurality of hinges and can be adjusted to fit within a decorative container of choice. The bracing mechanism contacts the decorative container for supporting the tree or pole.

The support also includes an inner container or holder and is received by the outer container. The inner container receives the tree or pole. The inner container further includes a plurality of apertures and bolts connected therethrough to contact the trunk of a tree or pole.

The support also includes a tree plate which rests in the bottom of the inner container. The tree plate includes a member for insertion into the bottom of a tree trunk or pole to provide further stability.

The invention allows the user to utilize a decorative container. The container conceals the support or stand itself so that only the decorative container is seen. Virtually any shape of container may be utilized. No cover-ups or tree skirts are necessary. The stand may be used indoors or outdoors. Further, the container may be utilized to hold live or artificial greenery surrounding the support for the tree.

The invention provides a support for a tree or the like including an outer container, an inner container slidably receivable by the outer container and a plurality of braces connected to the outer container.

According to another aspect of the invention a support is disclosed which includes a first holder, having a generally cylindrical shape and an aperture; a second holder, having a generally cylindrical shape and an aperture, and receivable by the first holder; a member for insertion into the tree or the like, the member being receivable by the second holder; a plurality of braces, the braces connected to the first holder; and a container for receiving the first holder whereby the braces abut the sides of the container for support of the tree or the like.

These and other advantages and features of the invention are pointed out with particularity in the claims annexed hereto and forming a further part hereof. However, for a better understanding of the invention, its advantages and objectives obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals represent like parts throughout the several views.

DETAILED DESCRIPTION

Figure 1:
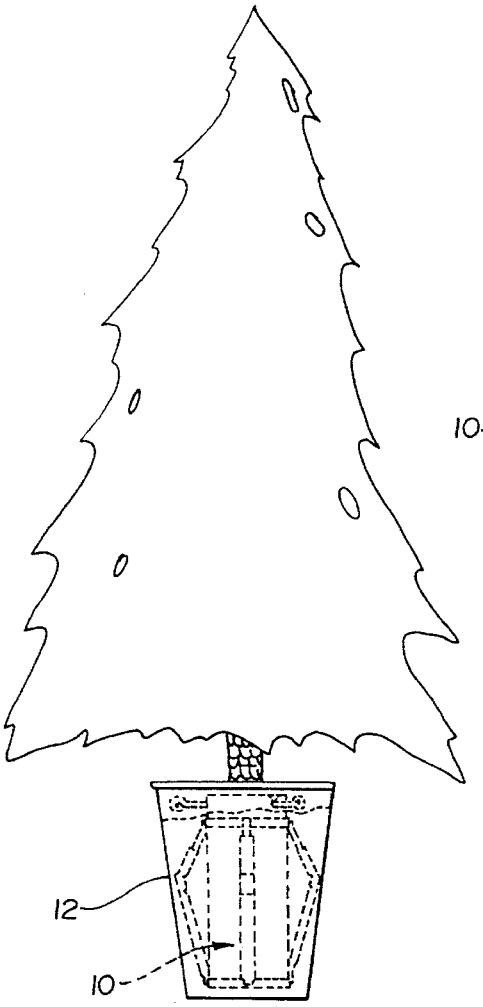
FIG. 1 is an orthographic side elevational view of the invention within its environment.

As described above, the invention is a stand for a tree or the like. As shown in FIG. 1, support 10 is designed to fit into a decorative container 12 for the purpose of holding live cut or artificial trees. It should be understood that the invention may also be utilized to support any type of pole structure such as garden candles, lawn umbrellas or flags.

The support 10 rests in a pot or container 12 in the preferred use of the invention. The support 10 is secured within the decorative container 12 and may then be filled with sand, soil, or pebbles to help secure and stabilize it. In this manner, plants may be planted in the soil added to the container 12 or artificial greenery or flowers may be inserted to further decorate the container 12. Although it is understood that the support 10 will hold an object without the decorative container 12, the container adds a degree of stability to the invention. The container 12 may be of a variety of shapes and sizes.

Figure 2:
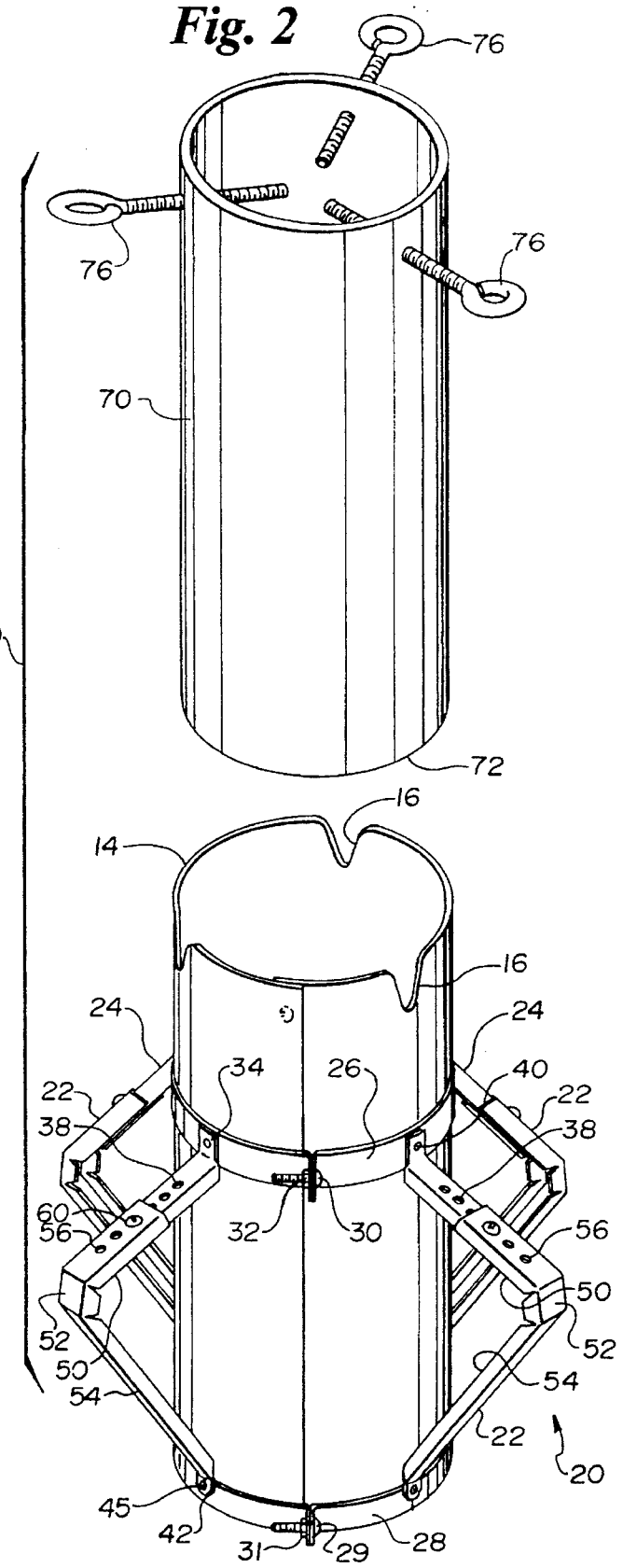
FIG. 2 is an exploded perspective view showing the components of the preferred embodiment.
Figure 3:
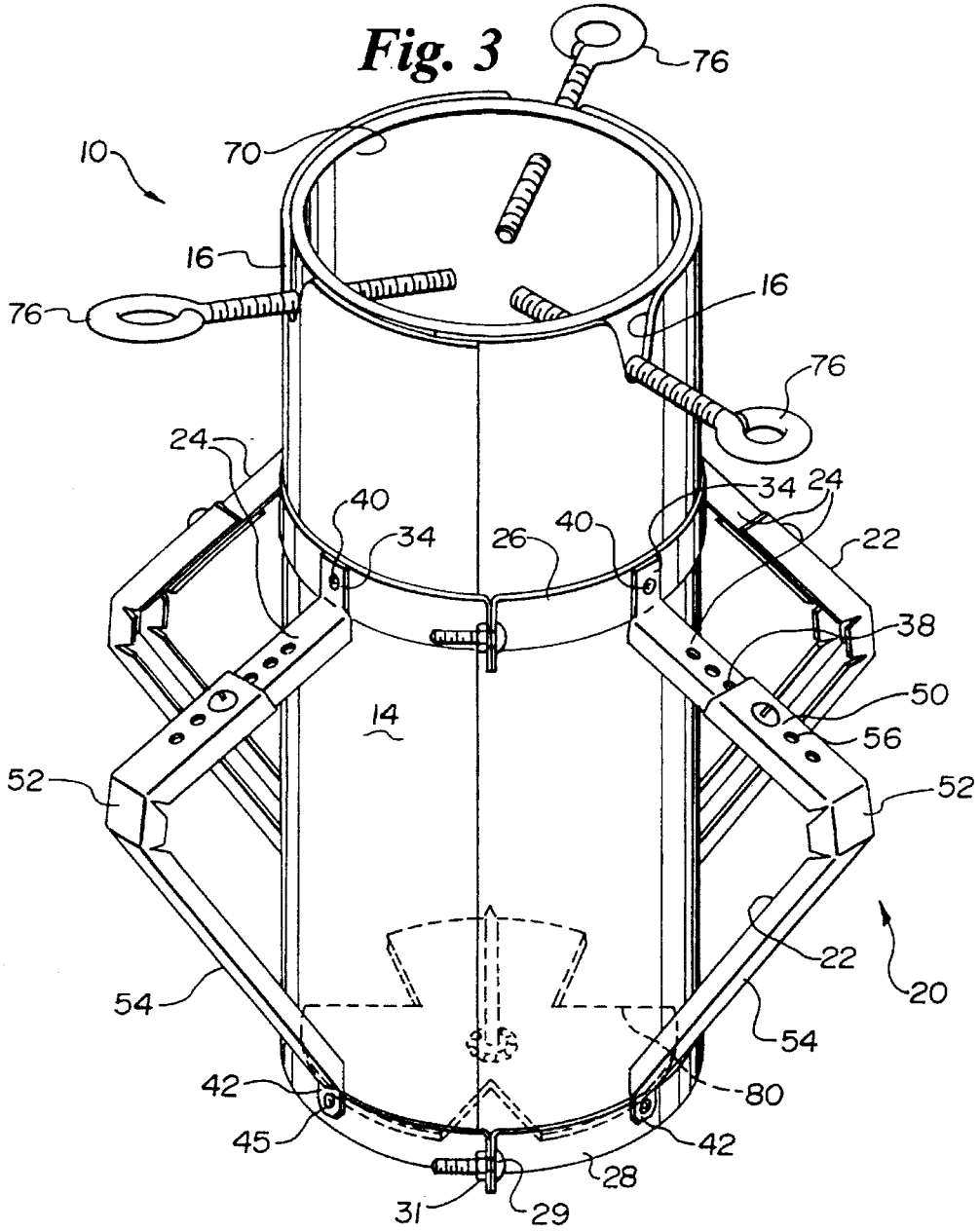
FIG. 3 is a perspective view illustrating the invention fully assembled.

Referring now to FIGS. 2 and 3, the support 10 is shown. The support includes an outer container or holder 14. In the preferred embodiment, the outer container 14 is generally cylindrical in shape and is made of galvanized steel. It should be understood that any configuration or material within the spirit of the invention may be utilized. The outer container 14 is cut from a sheet, shaped and welded at the edge or spot welded to cream the cylindrical shape in the preferred embodiment. The outer container 14 also includes a plurality of v-shaped cut-outs 16. These cut-outs may be u-shaped or any other shape which allows for an inner container 18 to show through. Three cut-outs 16 are utilized in the preferred embodiment.

The invention also includes a bracing mechanism 20. The bracing mechanism 20 includes a plurality of angle channel arms 22, a plurality of straight channel arms 24, a transferable strap 26, and a stationary strap 28. The bracing mechanism is shown in FIGS. 2, 3, 8 and 11. The transferable strap 26 receives the outer container 14. The transferable strap 26 is generally shaped to form a c-clamp and is made of galvanized steel in the preferred embodiment. Two holes (not shown) are made in the ends of the strap. A bolt 30 and nut 32 are utilized to position the strap 26 onto the container 14. It should be understood that any other suitable means for securing the strap 26 to the outer container 14 or any shape for the strap within the spirit of the invention may be utilized.

In the preferred embodiment, four straight channel arms 24 are connected to the transferable strap 26. The straight channel arms 24 include a lip 34. The lip 34 includes a hole 36 (not shown) for connection to the strap 26. The straight channel arms 24 are equally spaced around the strap and connected by means of an eyelet 40 in the preferred embodiment. The straight channel arms 24 include a plurality of holes 38. The straight channel arms 24 are generally u-shaped in cross section and are made of galvanized steel in the preferred embodiment.

The stationary strap 28 receives and envelops the outer container 14. The stationary strap 28 is generally shaped to form a c-clamp. Two holes (not shown) are made in the ends of the strap 28. A bolt 29 and nut 31 are utilized to position the strap 28 onto the container 14. It should be understood that any other suitable means for securing the strap 28 to the container 14 or any shape of strap may be utilized. The strap is 28 made of galvanized steel in the preferred embodiment.

As stated above, angled channel arms 22 are utilized in the bracing mechanism 20. The angled channel arm 22 includes a first portion 50, a contact portion 52 and a second portion 54. The angled channel arms 22 are constructed so that they may bend as desired. The first portion includes a plurality of holes 56. The contact portion 52 is positioned between and connected to the first and second portions 52 and 56. The second portion 54 includes a lip 42 for connection to the stationary strap 28. The lip 42 includes a hole 44 (not shown). The angled channel arms 22 are equally spaced around the stationary strap 28 and are connected by eyelets 45. The angled channel arms 22 are generally u-shaped in cross section and are made of galvanized steel in the preferred embodiment. The channel arms may be made of one or several parts although they are shown in one piece in the preferred embodiment.

Figure 9:
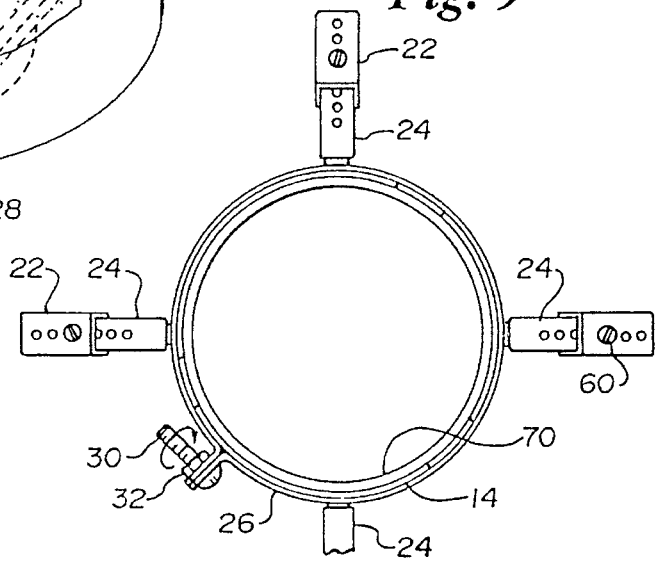
FIG. 9 is a top plan view illustrating the adjustable brace of the invention.

In operation, the straight channel arms 24 and angle channel arms 22 work together to form a hinge. The angle arms 22 are configured to slidably engage the straight arms 24. As seen in FIG. 9, the straight arms 24 are received by the angle arms 22. Then, the desired holes of the straight arm 24 and angled arm 22 are matched. A bolt 60 and nut 62 (not shown) arrangement is utilized to connect the arms 22 and 24.

Figure 8:
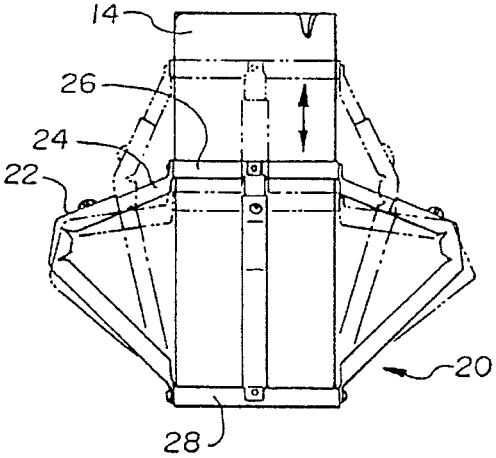
FIG. 8 is a side elevational view of the invention demonstrating the movement of the adjustable brace of the invention.
Figure 10:
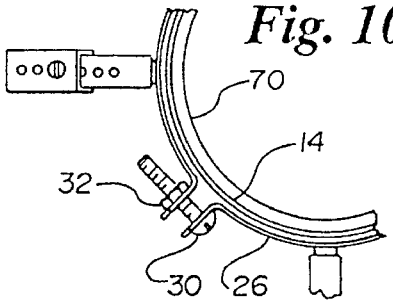
FIG. 10 is a partial top plan view illustrating the adjustable brace.

Referring now to FIGS. 8 and 10, the bracing mechanism 20 is shown as used in the invention. The transferable strap 26 is loosened at nut 30 and bolt 32 and the hinges formed by channels 22 and 24 may be moved up and down the container 14. The arms 22 and 24 are adjusted to fit properly within a decorative container so that the contact portion 52 of the adjustable arms 22 is in contact with the inner wall 13 of the decorative container 12. When proper placement and diameter has been established, the nut and bolt arrangements are tightened for a secure device.

The support or stand 10 also includes an inner canister 70. The inner holder or canister 70 is designed to be received by the outer container 14. In the preferred embodiment, the canister 70 is generally cylindrical in shape and includes a bottom 72. The canister 70 is designed so that it can hold water for use with a live cut tree. The canister 70 also includes a plurality of apertures 74 (not shown) for receiving eye bolts 76. The eye bolts 76 are utilized to position the tree or pole within the container 70. In the preferred embodiment, the canister 70 and bottom 72 are made of polyvinyl chloride. The bottom 72 is connected to the canister 70 by means of adhesive to provide a sealed fit.

Figure 4:
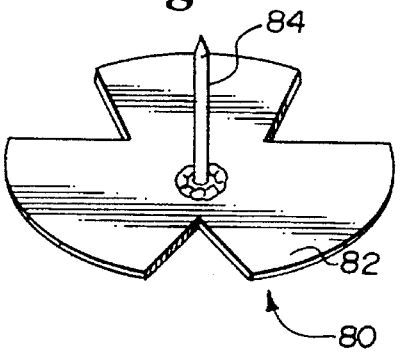
FIG. 4 is a perspective view illustrating a tree plate of the invention.
Figure 5:
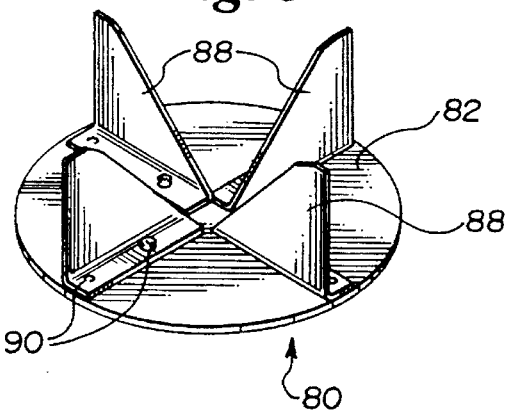
FIG. 5 is a perspective view illustrating an alternative tree plate of the invention.
Figure 6:
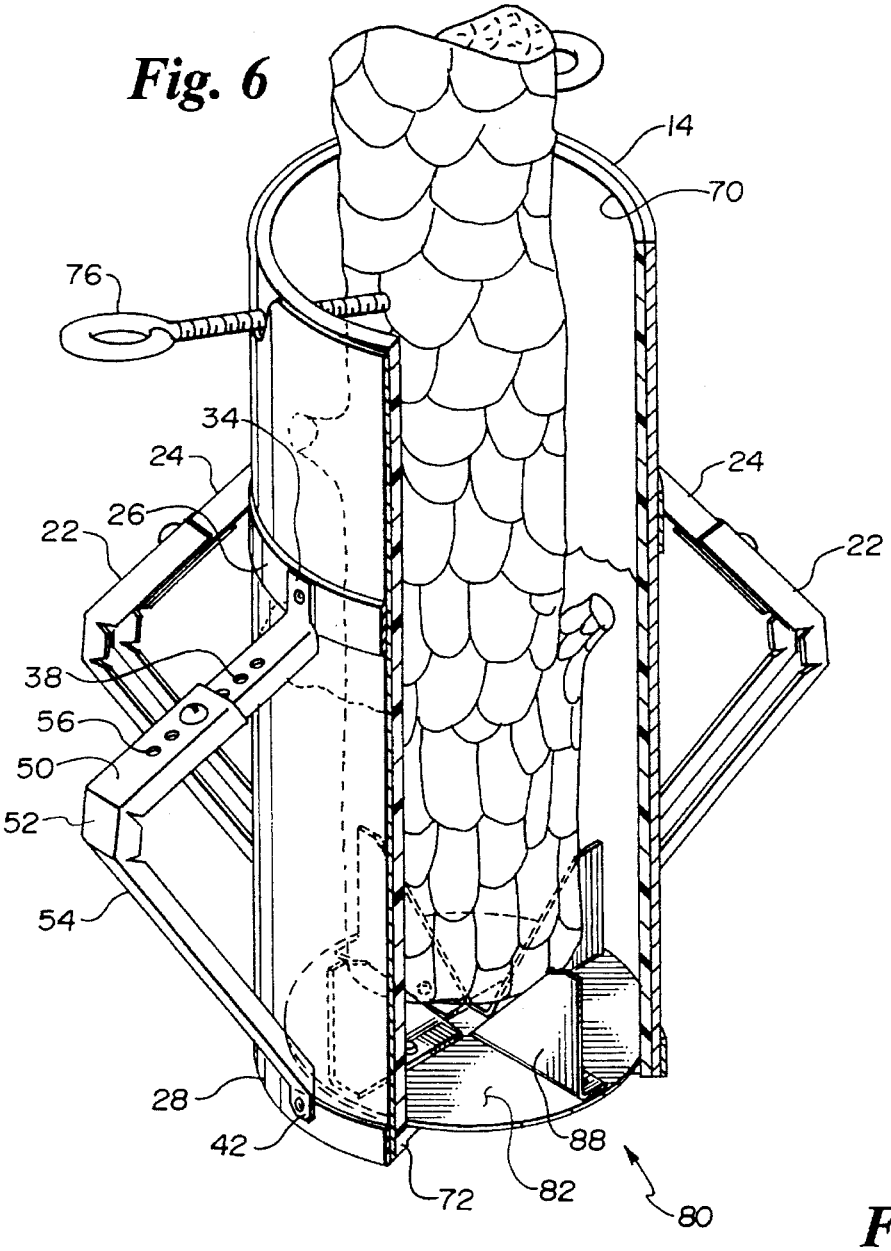
FIG. 6 is a perspective view with a partial cutaway illustrating the invention in use.
Figure 7:
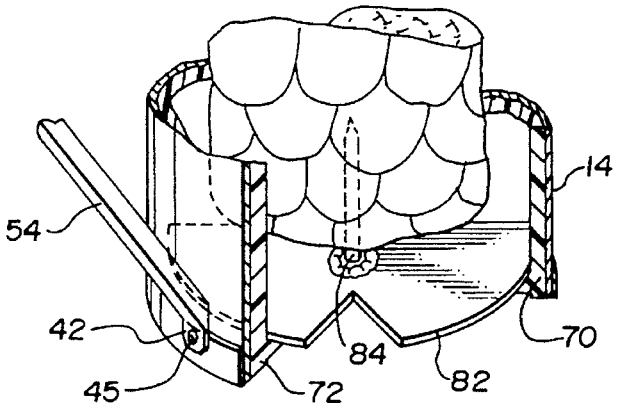
FIG. 7 is a fragmentary perspective view with a partial cutaway illustrating the invention with an alternate base plate.
Figure 11:
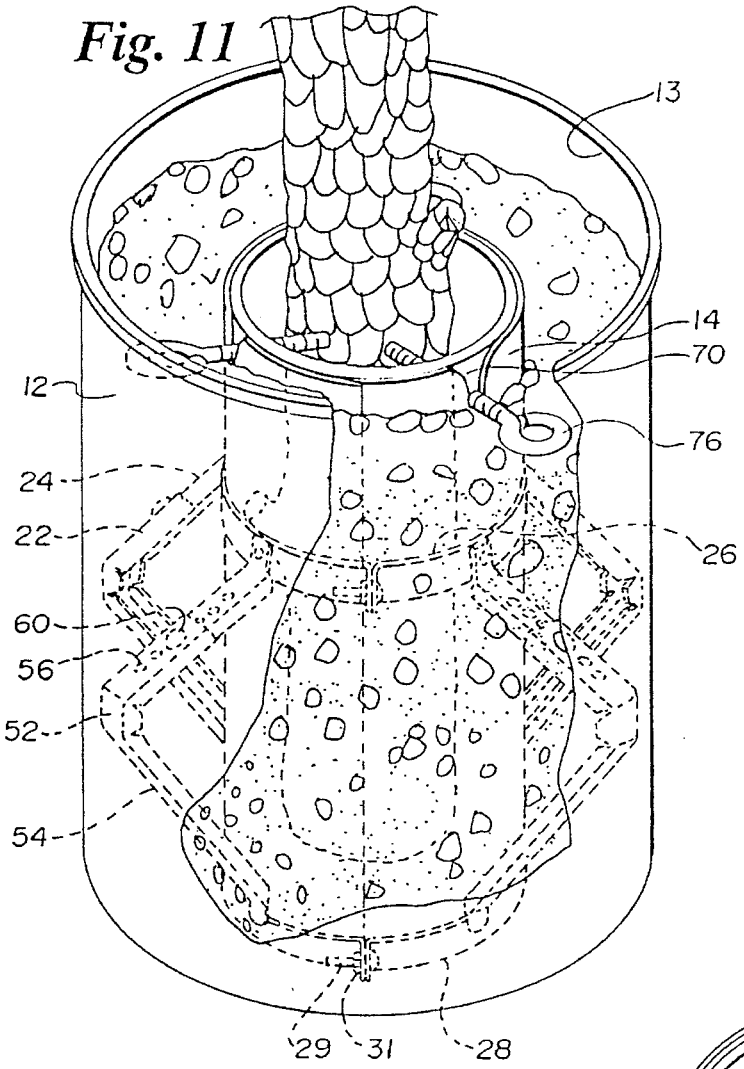
FIG. 11 is a cut-away perspective view illustrating the full usage of the invention.

Referring now to FIGS. 3, 4, 5, 6, and 7, the support 10 also includes a tree plate 80. The tree plate 80 includes a base 82 and means for contacting the tree or other object 84. The means for contacting the tree 84 may include a variety of members. As shown in FIG. 4, a nail is welded to the base 82. As seen in FIG. 5, a plurality of fins 88 are connected to the base 82 by rivets 90. Each of these embodiments of the plate 80 is embedded into the tree to secure in the canister. The tree plate 80 is configured so that it is received by the canister 70 and rests on the bottom 72. The tree may then be lowered into the canister 70 and forced onto the tree plate 80. The tree plate 80 may also be inserted into the tree before they are inserted into the canister 70.

Thus, to use the invention in full assembly the user chooses a decorative container 12 for the tree or the like. The user then adjusts the bracing mechanism 20 of the insertion to fit within and abut the inside of container 12. As described above, the transferable strap 26 is moved up or down and arms 22 and 24 are adjusted at their connection and hinged in or out to fit the container 12. The holder or outer container 14 is then secured within decorative container 12. Inner container 70 may then be placed within outer container 14. Tree plate 80 is inserted within the inner canister 70 and the tree may be inserted into the canister 70 and forced into plate 80. Eye bolts 76 may then be tightened against the trunk of the tree to center it within the canister 70 as desired. If the tree is alive, water may be added to the canister 70. Also, the user may wait to add soil, sand or the like around container 14 to further secure the tree stand. Plants or artificial greenery or decorations may be added to the sand/soil in decorative container 12.

While a particular embodiment of the invention has been described with respect to its application for holding and supporting trees and poles, it will be understood by those skilled in the art that the invention is not limited to such application or embodiment or to the particular components disclosed and described herein.

It will be appreciated by those skilled in the art that other configurations that embody the principles of this invention and other applications other than as described herein can be configured within the spirit and the intent of this invention. The configuration described herein is provided only as an example of one embodiment that incorporates and practices the principles of this invention. Other modifications and alterations well within the knowledge of those skilled in the art are to be included within the broad scope of the appended claims.

What is claimed is:

1. A support for a tree or pole structure, comprising:

(a) a first holder having a generally cylindrical shape and an aperture;

(b) a second holder having a generally cylindrical shape, a top end, a bottom end and an aperture defining the top end and being removably slidably receivable by the first holder;

(c) a fixing member for insertion into the tree or pole structure, the fixing member being removably receivable by the second holder and resting on the bottom end of the second holder; and (d) a plurality of braces adapted to abut an inner wall of a container, thereby bracing the support in the container, each brace including a first arm and a second arm, said first arm having first and second ends, said first end of said first arm, the braces connected to an upper portion of the outside of the first holder, said second arm having a first end and a second end, said first end of said second arm slidably, adjustably connected to said second end of said first arm, and said second end of said second arm connected to a lower portion of said first holder.

2. The support of claim 1 wherein the braces include a securing means for connecting the first and second arms together, said first and second arms each having a plurality of apertures for adjustment.

3. The support of claim 2 wherein the braces are connected to an adjustable strap where the strap slides along the first holder.

4. The support of claim 3 further including a container for receiving the first holder whereby the braces abut the sides of the container for support of the tree or pole structure.

5. A support for a tree or pole structure, comprising:

(a) an outer container;

(b) an inner container removably slidably receivable by the outer container; and (c) a plurality of braces adapted to abut an inner wall of a third container, thereby bracing the support in the third container, each brace including a first arm and a second arm, said first arm having first and second ends, said first end of said first arm connected to the outer container, said second arm having a first end and a second end, said first end of said second arm slidably, adjustably connected to said second end of said first arm, and said second end of said second arm connected to a lower portion of said outer container.

6. The support of claim 5 wherein the inner container includes a top and a bottom where the top includes an aperture for receiving a tree or pole structure and the bottom includes an end cap.

7. The support of claim 5 wherein the inner container is generally cylindrical.

8. The support of claim 5 wherein the outer container is generally cylindrical.

9. The support of claim 5 further comprising a means for securing the tree or pole structure.

10. The support of claim 9 wherein the means for securing the tree or pole structure includes a plate and at least one member connected to the plate wherein the plate removably rests at the bottom of the inner container and the member is insertable into the tree or pole structure.

11. The support of claim 10 wherein the member is generally fin shaped.

12. The support of claim 10 wherein the member is generally prong shaped.

13. The support of claim 5 wherein the pole structure is a flag.

14. The support of claim 5 wherein the pole structure is a lawn umbrella.

15. The support of claim 5 wherein the pole structure is a garden candle.

16. The support of claim 5 wherein the inner container includes a plurality of apertures proximate the top.

17. The support of claim 16 further comprising means for contacting the tree or pole structure connected through the apertures of the inner container.

18. The support of claim 13 wherein the means for contacting the tree or pole structure includes a plurality of bolts.

19. A support for a tree or pole structure, comprising:

(a) a first holder having a generally cylindrical shape and an aperture;

(b) a second holder having a generally cylindrical shape, a top end, a bottom end and an aperture and slidably removably receivable by the first holder;

(c) a fixing member for insertion into the tree or pole structure, the fixing member being removably receivable by the second holder and resting on the bottom end of the second holder;

(d) a plurality of braces, the braces connected to the outside of the first holder; and (e) a container for receiving the first holder, the container having an inside wall whereby the braces abut the inside wall of the container for support of the tree or pole structure.

20. A support for a tree or pole structure, comprising:

(a) an outer cylindrical container having an open top end and a bottom end, and having a longitudinal axis;

(b) an inner cylindrical container having an open top end, a closed bottom end and a longitudinal axis, the inner container being removably slidably received by the outer container through the outer container's open top end, and wherein the longitudinal axis of the outer container and the longitudinal axis of the inner container are substantially co-linear after reception;

(c) wherein the tree or pole structure has a top end, a bottom end and a longitudinal axis, and the bottom of the tree or pole structure is removably slidably receivable by the inner container, and wherein the longitudinal axis of the tree or pole structure, the longitudinal axis of the inner container and the longitudinal axis of the outer container are substantially co-linear after the reception;

(d) a plurality of braces connected to the outside of the outer container, arrayed at discrete points around the outside perimeter of the outer container; and (e) a third container having an inner wall, for receiving the outer container whereby the braces abut the inner wall of the third container for support of the tree or pole structure.

21. The support of claim 20 further comprising a fixing member for insertion into the bottom end of the tree or pole structure, the fixing member being removably receivable by the inner container and resting on the bottom of the inner container.

22. The support of claim 21, wherein the fixing member is generally fin shaped.

23. The support of claim 21, wherein the fixing member is generally prong shaped.

24. The support of claim 20, wherein each brace comprises:

(a) a first member having a first end and a second end;

(b) a second member having a first end and a second end;

(c) a securing means for connecting the first end of the first member to the base of the outer container;

(d) a second securing means for connecting the first end of the second member to the side of the outer container; and (e) an abutment point formed by the second end of the first member and the second end of the second member, each member having a plurality of apertures for adjustment of the proximity of the abutment point to the outer container.

25. The support of claim 24, wherein the second securing means is an adjustable strap slidably connected to the outer container along the longitudinal axis of the outer container.

26. The support of claim 25, wherein the abutment point moves closer in proximity to the outer container when the adjustable strap slides toward the top of the outer container.

27. The support of claim 26, wherein the abutment points of the braces abut the inner wall of the third container.

* * * * *

UNITED STATES PATENT AND TRADEMARK OFFICE

CERTIFICATE OF CORRECTION

PATENT NO. : 5,482,245

DATED : January 9, 1996

INVENTOR(S) : LORI GRAVES

It is certified that error appears in the above—identified patent and that said Letters Patent is hereby corrected as shown below:

Col. 5, line 62, after "connected to" insert -- an upper portion of --

Signed and Sealed this

Second Day of April, 1996

Bruce Lehman

*Attest:*

BRUCE LEHMAN

*Attesting Officer*

*Commissioner of Patents and Trademarks*